US006221571B1

(12) United States Patent
Zengerle et al.

(10) Patent No.: US 6,221,571 B1
(45) Date of Patent: Apr. 24, 2001

(54) SILVER HALIDE LIGHT-SENSITIVE ELEMENT

(75) Inventors: Paul L. Zengerle, Rochester; Gary N. Barber, Penfield, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/208,894

(22) Filed: Dec. 10, 1998

(51) Int. Cl.[7] ..... G03C 7/34

(52) U.S. Cl. ..... 430/546; 430/631; 430/638; 430/552; 430/553; 430/503

(58) Field of Search ..... 430/638, 631, 430/503, 546, 552–553.3

(56) References Cited

U.S. PATENT DOCUMENTS

| | | | | |
|---|---|---|---|---|
| 2,322,027 | | 6/1943 | Jelley et al. . | |
| 4,731,320 | | 3/1988 | Sasaki et al. . | |
| 4,840,878 | | 6/1989 | Hirose et al. . | |
| 4,923,783 | * | 5/1990 | Kobayashi et al. | 430/377 |
| 5,009,989 | | 4/1991 | Aoki et al. . | |
| 5,077,188 | | 12/1991 | Tanji et al. . | |
| 5,200,304 | * | 4/1993 | Yoneyama et al. | 430/505 |
| 5,594,047 | * | 1/1997 | Nielsen et al. | 523/315 |

FOREIGN PATENT DOCUMENTS

353714 * 2/1990 (EP) .

* cited by examiner

*Primary Examiner*—Hoa Van Le
*Assistant Examiner*—Amanda C. Walke
(74) *Attorney, Agent, or Firm*—Andrew J. Anderson

(57) ABSTRACT

A silver halide light sensitive photographic element is disclosed comprising a support bearing at least one cyan image forming hydrophilic colloid layer comprising cyan image dye forming coupler of Formula I and benzoic acid ester or diester high boiling solvent of Formula II.

Formula I wherein $R_a$ is an alkyl group, $R_b$ is a ballast group, and X is hydrogen or a coulping-off group.

Formula II wherein: each m is independently 0, 1, 2 or 3; each $R_1$ is an individually selected alkyl group with up to four carbon atoms; n is 1 to 7; each $R_2$, $R_3$, $R_4$ and $R_5$ may be the same or different and is individually selected from hydrogen or an alkyl group with up to four carbon atoms; p is 0 to 3; q is 1 to 7; r is 0 or 1; and the log P of the solvent is at least 4.0. The photographic elements of the invention provide high cyan coupler reactivity and form deep cyan dye hues upon photographic processing without degrading cyan dye dark stability. The elements are relatively insensitive to processing developer modifications and employ solvents which are expected to have low undesirable biological effects.

19 Claims, No Drawings

SILVER HALIDE LIGHT-SENSITIVE ELEMENT

TECHNICAL FIELD

This invention relates generally to the field of silver halide light sensitive elements, and in particular to photographic elements having at least one cyan imaging layer containing benzoic acid ester or diester coupler solvents. In a particular aspect it relates to motion picture print films.

BACKGROUND OF THE INVENTION

Various techniques are known for dispersing hydrophobic photographically useful compounds such as photographic couplers into photographic element layer coating compositions comprising hydrophilic colloids.

Photographic dye forming couplers, as well as other hydrophobic photographically useful compounds, are typically incorporated into a hydrophilic colloid layer of a photographic element by first forming an aqueous dispersion of the couplers and then mixing such dispersion with the layer coating solution. An organic solvent is typically used to dissolve the coupler, and the resulting organic solution is then dispersed in an aqueous medium to form the aqueous dispersion.

The organic phase of these dispersions frequently includes high boiling or permanent organic solvents, either alone or with low boiling or partly water soluble solvents which are removed after dispersion formation. Permanent high boiling solvents have a boiling point sufficiently high, generally above 150° C. at atmospheric pressure, such that they are not evaporated under normal dispersion making and photographic layer coating procedures. Permanent high boiling coupler solvents are primarily used in the conventional "oil-protection" dispersion method whereby the organic solvent remains in the dispersion, and thereby is incorporated into the emulsion layer coating solution and ultimately into the photographic element.

The conventional "oil in water" dispersion method for incorporating hydrophobic couplers is described, e.g., in U.S. Pat. No. 2,322,027 by Jelly and Vittum. In such conventional process, the coupler is dissolved in a high boiling water immiscible solvent, mixed with aqueous gelatin, and dispersed using a colloid mill or homogenizer. The presence of the high boiling solvent provides a stable environment for the hydrophobic coupler, as well as generally increasing the reactivity of the coupler upon photographic processing.

Cyan image dye forming couplers of Formula I below wherein $R_a$ is an alkyl group, $R_b$ is a ballast group and X is hydrogen or a coupling-off group, have been found to be very useful in color photographic elements.

Formula I

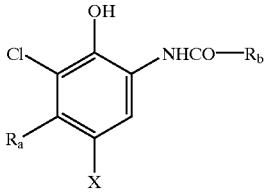

In general, such couplers are relatively easy to synthesize and therefore have low manufacturing costs. Phthalic acid esters such as dibutylphthalate have been found to be very useful as coupler solvents in combination with couplers of Formula I. These coupler solvents enable these couplers to provide high reactivity with oxidized color developer. Such solvents also shift the cyan image dye formed from these couplers bathochromically (to longer wavelengths), which is desirable for color reproduction. They also provide cyan image dyes with adequate light and dark stability. Dibutylphthalate, however, has been identified as possessing potentially undesirable biological properties. Hence, it is desired to identify alternative solvents to be used with these cyan couplers, which are more benign in terms of their potential health and environmental effects, but still maintain all of the desirable photographic properties.

Alternative coupler solvents which deliver all of the desired features with these couplers must meet a fairly specific set of criteria. In order to deliver high coupler reactivity, alternative solvents must have sufficiently low viscosity. It is also necessary for potential alternative solvents to have sufficient polarity to shift the cyan dye hue bathochromically. It is also important for the solvent to be relatively hydrophobic so that most of it remains present in the layer in which it was coated and is not removed from the coating to an appreciable extent during processing in order to provide good dark stability of cyan image dyes formed from these couplers.

The selection of an alternative solvent for use with cyan dye forming couplers of Formula I has accordingly required significant exploration and research in order to provide a coupler dispersion which provides desired functionality. It would be desirable to provide a silver halide photographic element which contains a cyan image forming layer comprising a cyan coupler of Formula I and a coupler solvent which meets such objectives.

SUMMARY OF THE INVENTION

One embodiment of the invention comprises a silver halide light sensitive photographic element comprising a support bearing at least one cyan image forming hydrophilic colloid layer comprising cyan image dye forming coupler of Formula I and benzoic acid ester or diester high boiling solvent of Formula II.

Formula I

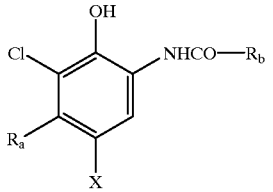

wherein $R_a$ is an alkyl group, $R_b$ is a ballast group, and X is hydrogen or a coupling-off group.

Formula II

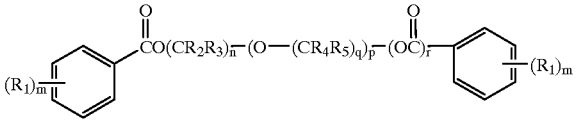

wherein: each m is independently 0, 1, 2 or 3; each $R_1$ is an individually selected alkyl group with up to four carbon atoms; n is 1 to 7; each $R_2$, $R_3$, $R_4$ and $R_5$ may be the same or different and is individually selected from hydrogen or an alkyl group with up to four carbon atoms; p is 0 to 3; q is 1 to 7; r is 0 or 1; and the log P of the solvent is at least 4.0.

In a preferred embodiment, a silver halide light sensitive photographic element is described comprising a support bearing in sequential order on one side thereof at least one yellow image forming hydrophilic colloid layer comprising a blue-sensitive silver halide emulsion and yellow image dye forming coupler, at least one cyan image forming hydrophilic colloid layer comprising red-sensitive silver halide emulsion and cyan image dye forming coupler, and at least one magenta image forming hydrophilic colloid layer comprising green-sensitive silver halide emulsion and magenta image dye forming coupler; wherein the cyan image forming layer comprises a coupler of Formula I and a solvent of Formula II as described above.

ADVANTAGES

The photographic elements of the invention provide high cyan coupler reactivity and form deep cyan dye hues upon photographic processing without degrading cyan dye dark stability. The elements are relatively insensitive to processing developer modifications and employ solvents which are expected to have low undesirable biological effects.

DETAILED DESCRIPTION

The photographic elements of the invention comprise at least one cyan image forming hydrophilic colloid layer comprising cyan image dye forming coupler of Formula I and a benzoic ester or diester high boiling solvent of Formula II.

In Formula I, $R_a$ represents an alkyl group substituent, which may be linear or branched, and may be substituted or unsubstituted. Preferably, such alkyl group comprises from 2 to 15 carbon atoms, more preferably from 2 to 4 carbon atoms, and most preferably is an ethyl substituent.

$R_b$ represents a ballast group which controls the migration of the coupler when coated in a photographic layer. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to a ballast in the form of a polymeric backbone. Preferred ballast groups include —CHR'-O-Aryl, where R' represents an alkyl group (preferably 1 to 12 carbon atoms) and Aryl represents an aryl substituent (e.g., phenyl) which may be substituted by, e.g., an alkyl, hydroxy, or alkylsulfonamido group, with branched alkyl group substituents such as t-butyl and t-pentyl being preferred.

Coupling-off groups are well known in the art. Such groups can modify the reactivity of the coupler and determine the equivalent number of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Exemplary couplers of Formula I which may be used in an element in accordance with the invention include the following:

C-1

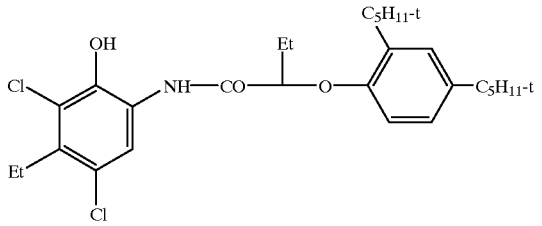

C-2

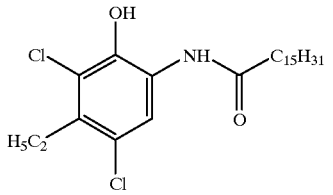

C-3

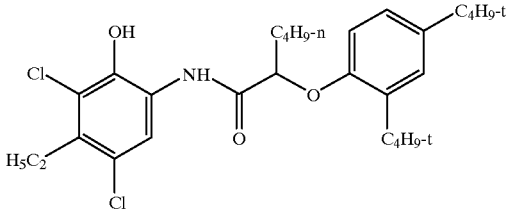

C-4

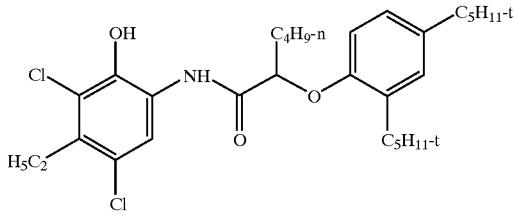

C-5

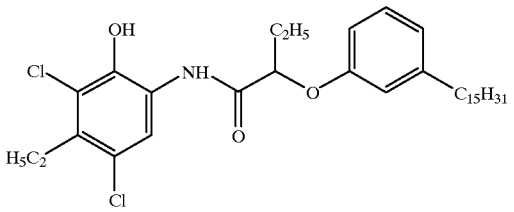

Additional couplers of Formula I which may be used in accordance with the invention include those disclosed in U.S. Pat. Nos. 4,731,320 and 5,009,989, the disclosures of which are hereby incorporated by reference herein.

The term "high boiling solvent" as used herein refers to coupler solvents having a boiling point of above 150° C. Benzoic acid esters and diesters of Formula II must have a log P of greater than 4.0 for use in accordance with the invention, and is more preferably at least 4.5. The log P parameter is a well-known measurement of the solubility of a compound in aqueous liquids compared to its solubility in a nonpolar organic solvent (octanol). The log P parameter is further described, along with data for organic compounds, in C. Hansch & T. Fujita, J. Am. Chem. Soc., 86, 1616–25 (1964) and A. Leo & C. Hansch, *Substituent Constants for Correlation Analysis in Chemistry and Biology*, Wiley, New York (1979), the disclosures of which are incorporated herein by reference. If the log P of the benzoic acid ester or diester organic solvent contained in the cyan dye forming imaging layer is less than 4.0, it will be relatively more hydrophilic, and more prone to migrating through the hydrophilic colloid layers of the photographic elements and degrade the dark stability of the image dyes formed upon exposure and processing of the photographic elements of the invention.

Solvents having a relatively high log P in accordance with preferred embodiments of the invention may be so highly hydrophobic that it is difficult to measure their water solubility using standard techniques. Such compounds may have a solubility in water, e.g., of less than 1.0 $\mu$g/mL. In such cases, log $P_{(calc)}$ is a useful means to characterize their hydrophobicity, where log $P_{(calc)}$ is the logarithm of the value of the octanol/water partition coefficient (P) of the compound calculated using MedChem, version 3.54, a software package available from the Medicinal Chemistry Project, Pomona College, Claremont, Calif. Log $P_{(calc)}$ is a parameter which is highly correlated with measured water solubility for compounds spanning a wide range of hydrophobicity.

In accordance with preferred embodiments of the invention, the solvents of Formula II have a viscosity at 25° C. of less than 100 centipoise, more preferably less than 50 centipoise. While use of higher viscosity solvents of Formula II is included within the invention, such solvents should generally be used in solvent blends with lower viscosity solvents in order to provide desired levels of reactivity for couplers of Formula I.

In one useful embodiment of the invention, each m in Formula II is 0. In another useful embodiment, each m is 1 and each $R_1$ is a methyl group. In accordance with one embodiment of the invention, when p and r are 0 in Formula II, the sum of the number of carbon atoms in each $R_1$ plus each $R_2$ plus each $R_3$ taken together is preferably 2 to 7, more preferably 3 to 5. In accordance with another embodiment of the invention, when p is 0 and r is 1, the sum of the number of carbon atoms in each $R_1$ plus each $R_2$ plus each $R_3$ taken together is preferably 4 to 8. In accordance with yet another embodiment, when p is 1 and r is 1, the sum of the number of carbon atoms in each $R_1$ plus each $R_2$ plus each $R_3$ plus each $R_4$ plus each $R_5$ taken together is preferably 6 to 10. Specific examples of benzoic acid ester and diester solvents of Formula II which may be used in accordance with the invention include the following solvents S-1 through S-8:

S-1

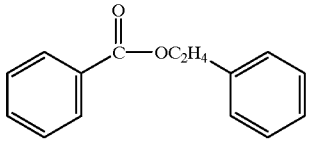

-continued

S-2

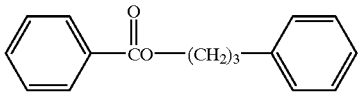

S-3

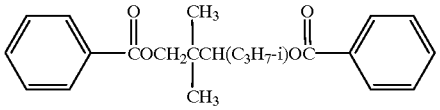

S-4

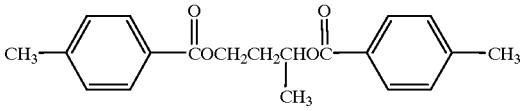

S-5

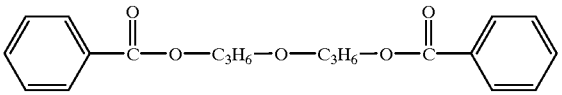

S-6

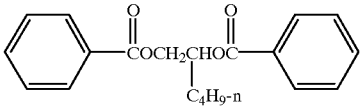

S-7

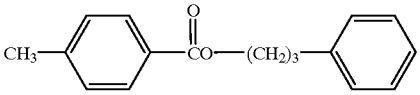

S-8

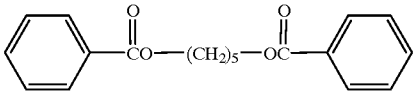

The high-boiling ester and di ester solvents of Formula I employed in the invention may be commercially available or may be synthesized by methods known in the art. For example, an acid chloride of benzoic acid or of a substituted benzoic acid may be heated together with an equimolar amount of a phenylaikyl alcohol in the presence of an aprotic base such as triethyl amine. The reaction between the acid chloride and the alcohol to form the desired ester proceeds nearly to completion. The ester may be washed with water to remove any residual acid chloride, acid or dissolved amine hydrochloride. The high-boiling ester may then be purified by distillation under vacuum. Synthesis of the high-boiling solvents of the invention may also be carried out as described in Chem. Lett. 4, 625 (1992), 3, 515 (1994) and 2, 141 (1995). To prepare diesters, a diol may be similarly heated together with twice as many moles of the acid chloride of benzoic acid or of a substituted benzoic acid in the presence of the aprotic base such as triethyl amine. Additional examples of benzoic acid esters and diesters which may be used in accordance with the invention are disclosed in copending, commonly assigned U.S. Ser. Nos. 09/103,591 and 09/103,929, the disclosures of which are hereby incorporated by reference in their entireties.

Unless otherwise specifically stated, the term substituted or substituent means any group or atom other than hydrogen bonded to the remainder of a molecule. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Dispersions of cyan image forming couplers for use in the invention can be prepared by dissolving the couplers in the high boiling solvent of Formula II or a high boiling solvent blend including a solvent of Formula II, optionally with or without low boiling or partially water soluble auxiliary organic solvents. The resulting liquid organic phase may then be mixed with an aqueous gelatin solution, and the mixture is then passed through a mechanical mixing device suitable for high shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The auxiliary organic solvent, if present, may then be removed by evaporation, noodle washing, or membrane dialysis. If not removed prior to coating in a photographic element layer, partially water soluble auxiliary organic solvents may diffuse throughout the hydrophilic colloid layers of the element, and be removed during photographic processing. Useful weight ratios of coupler to high-boiling solvent range from about 1:0.1 to 1:8.0, with 1:0.3 to 1:2.0 being typical. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,170, 2,801,171, 2,949,360, and 3,396,027. Useful coated levels of the high-boiling benzoic acid ester and diester solvents range from about 0.02 to about 5.00 g/sq m, or more typically from 0.05 to 3.00 g/sq m.

Examples of suitable auxiliary solvents which can be used include: ethyl acetate, isopropyl acetate, butyl acetate, ethyl propionate, 2-ethoxyethylacetate, 2-(2-butoxyethoxy) ethyl acetate, triethylcitrate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like. Preferred auxiliary solvents include ethyl acetate and 2-(2-butoxyethyoxy) ethyl acetate.

The aqueous phase of the coupler dispersions preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

Multicolor photographic elements in accordance with preferred embodiments of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion hydrophilic colloid layer units sensitized to the red, green and blue regions of the spectrum. Each unit can comprise a single emulsion layer or multiple emulsion layers sensitive to a given region of the spectrum. The layers of the element, including the layers of the image forming units, can be arranged in various orders as known in the art. It is within the scope of this invention, however, for the light sensitive material to alternatively or additionally be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described, e.g., by Edwards et al. in International Publication No. WO 93/012465.

The invention is particularly useful with color photographic print elements, and especially to photographic print elements designed for exposure though a negative film and projection display, such as motion picture print and intermediate films. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure*, December, 1987, Item 17643, published by Industrial Opportunities Ltd., Homewell Havant, Hampshire, P09 1EF, United Kingdom, and *Research Disclosure*, September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

Photographic elements of the invention in accordance with particular embodiments preferably comprise photographic print elements. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically less than 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100 } crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

The yellow, cyan and magenta dye forming couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art as described above.

Cyan image dye forming couplers of Formula I may be used in combination with other cyan dye forming couplers in elements of the invention, including such couplers as are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961), European Patent Application Nos. 544,322; 556,700; 556,777; 565,096; 570,006; and 574,948.

Typical additional cyan couplers are represented by the following formulas:

CYAN-1

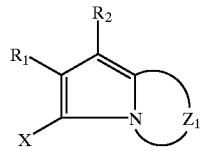

CYAN-2

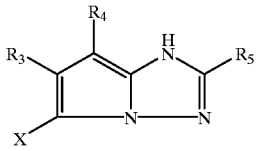

CYAN-3

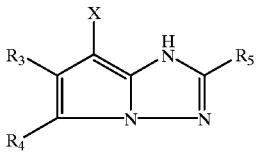

CYAN-4

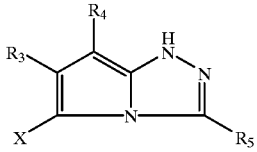

CYAN-5

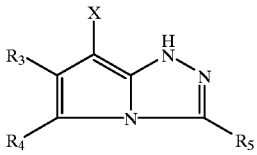

CYAN-6

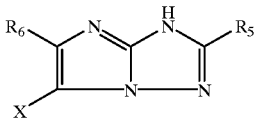

wherein $R_1$ and $R_5$ each represent a hydrogen or a substituent; $R_2$ represents a substituent; $R_3$ and $R_4$ each represent an electron attractive group having a Hammett's substituent constant $s_{para}$ of 0.2 or more and the sum of the $s_{para}$ values of $R_3$ and $R_4$ is 0.65 or more; $R_6$ represents an electron attractive group having a Hammett's substituent constant $s_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group. A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

More preferable are cyan couplers of the following formulas:

CYAN-7

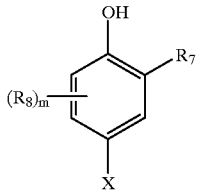

CYAN-8

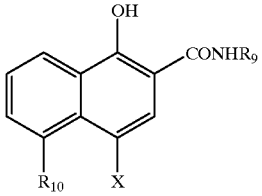

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S Pat. Nos. 4,659,652; 5,066,575; and 5,250,400.

Typical pyrazoloazole and pyrazolone couplers are represented by the following formulas:

MAGENTA-1

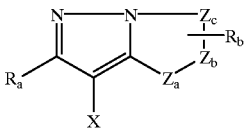

MAGENTA-2

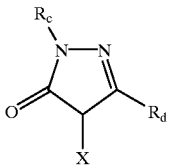

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$–$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

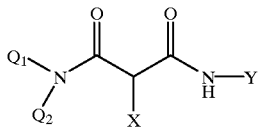

YELLOW-2

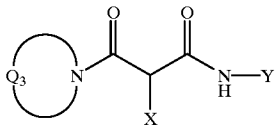

YELLOW-3

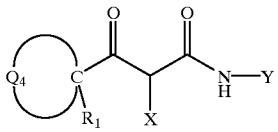

YELLOW-4

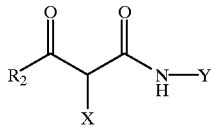

wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and Q4 represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-1 and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group.

Typical examples of photographic substituents which may be included in the yellow, cyan and magenta couplers which may be used in the elements of the invention include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

To control the migration of various components coated in a photographic layer, including couplers, it may be desirable to include a high molecular weight hydrophobe or "ballast" group in the component molecule as described above for the cyan couplers.

It may be useful to use a combination of couplers any of which may contain known ballasts or coupling-off groups such as those described in U.S. Pat. Nos. 4,301,235; 4,853,319 and 4,351,897.

If desired, the photographic element can be used in conjunction with an applied magnetic layer as described in *Research Disclosure*, November 1992, Item 34390. It is also specifically contemplated to use photographic elements according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

Photographic elements in accordance with the invention may comprise any conventional support materials, which may be reflective or transparent. Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). In addition to the light sensitive image forming layers described above, the photographic elements of the invention may include further features and layers as are known in the art, including, e.g., antistatic, antihalation, subbing, interlayer, backing, and overcoat layers. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

Photographic elements of the invention preferably comprise an antihalation layer comprising process removable filter dyes or silver. The antihalation layer may be located between the light sensitive layers and the support, or may be positioned on the back side of the support opposite to the light sensitive layers. The filter dyes and/or silver used in antihalation layers are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

The following examples illustrate the preparation of photographic elements in accordance with this invention.

EXAMPLE 1

80.0 g of cyan coupler C-1 was dissolved in 80.0 g of dibutylphthalate (CS-1) and 80.0 g of ethyl acetate at 70° C. This oil phase solution was then combined with an aqueous phase solution consisting of 80.0 g gelatin, 60.0 g of a 10% solution of Alkanol-XC (Dupont), and 620.0 g of distilled water. This mixture was then passed through a Gaulin colloid mill five times followed by removal of ethyl acetate by rotary evaporation. Distilled water was then added back to form Dispersion A, which consisted of 8.0% coupler and 8.0% gelatin. Dispersions B through L were similarly prepared using alternative solvents or solvent blends (1:1) instead of CS-1 as described in Table I.

Dispersion A was incorporated in a cyan monochrome photographic element (element 1) by coating the following layers on a gelatin subbed polyethylene terephthalate support with a rem-jet carbon black containing backing layer.

Layer 1: Red Light Sensitive Layer

AgClBr cubic grain emulsion, 0.87% Br, 0.15 micron, spectrally sensitized with SD-1, 0.051 mmole/Ag mole, supersensitizer compound (SS-1), 0.334 mmole/Ag mole, 489.8 mg/sq. m.

Cyan dye forming coupler (C-1) from Dispersion A, 968.8 mg/sq. m.

Coupler Solvent (CS-1), 968.8 mg/sq. m.

Gelatin, 3412 mg/sq. m.

Spreading aids.

Layer 2: Protective Overcoat Layer

Poly (dimethyl siloxane) 200-CS, 65.9 mg/sq. m.

Poly (methyl methacrylate) beads, 5.0 mg/sq. m.

Gelatin, 977.4 mg/sq. m.

Gelatin hardener.

Spreading aids.

Dispersions B through L were similarly incorporated into the previously described photographic element as elements 2 through 9, respectively, as described in Table I.

The elements were exposed for 1/500 second by means of a 3000K Tungsten light source through a 0–3 neutral density step tablet, a heat-absorbing filter, and a filter designed to represent a motion picture color negative film. After exposure, the elements were processed through Process ECP-2B with the exception that those steps specific to sound track development were omitted. The process consisted of a prebath (10"), water rinse (20"), color developer (3'), stop bath (40"), first wash (40"), first fix (40"), second wash (40'), bleach (1'), third wash (40"), second fix (40"), fourth wash (1'), final rinse (10"), and then drying with hot air.

The ECP-2B Prebath consists of:

| | |
|---|---|
| Water | 800 mL |
| Borax (decahydrate) | 20.0 g |
| Sodium sulfate (anhydrous) | 100.0 g |

-continued

| | |
|---|---|
| Sodium hydroxide | 1.0 g |
| Water to make 1 liter | |
| pH @ 26.7° C. is 9.25 +/− 0.10 | |
| The ECP-2B Color Developer consists of: | |
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0N) | 0.62 mL |
| Water to make 1 liter | |
| pH @ 26.7° C. is 10.53 +/− 0.05 | |
| The ECP-2B Stop Bath consists of: | |
| Water | 900 mL |
| Sulfuric acid (7.0N) | 50 mL |
| Water to make 1 liter | |
| pH @ 26.7° C. is 0.90 | |
| The ECP-2B Fixer consists of: | |
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |
| The ECP-2B Ferricyanide Bleach consists of: | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |
| The Final Rinse solution consists of: | |
| Water | 900 mL |
| Kodak Photo-Flo 200 (TM) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

The optical density due to dye formation was then measured on a densitometer using filters in the densitometer appropriate to the intended use of the photographic element. Dye density was then graphed versus log(exposure) to form the Red, Green, and Blue D-logE characteristic curves of the photographic elements. The optical density as a function of wavelength was also measured using a Hitachi Model U3410 UV-visible spectrophotometer, and the wavelength of maximum absorption (λmax) was recorded to obtain an assessment of cyan dye hue. The processed coatings were also assessed for cyan dye dark stability from red density losses (from an initial red density of 1.70) after 2 week 85° C./40% RH conditions.

TABLE I

Effect of Coupler Solvent on Fixed Upper Scale Contrast, Cyan Dye Hue, and Cyan Dye Dark Stability

| Element | Dispersion | Solvent | FUSC | λmax (nm) | Δ Red Density (85° C./40% RH) |
|---|---|---|---|---|---|
| 1 (Comparison) | A | CS-1 | 4.74 | 671.1 | −0.63 |
| 2 (Comparison) | B | CS-2 | 4.23 | 670.4 | −0.60 |
| 3 (Comparison) | C | CS-3 | 4.64 | 656.9 | −0.52 |
| 4 (Comparison) | D | CS-4 | 5.00 | 660.9 | −0.54 |
| 5 (Invention) | E | S-1 | 5.06 | 670.1 | −0.52 |

TABLE I-continued

Effect of Coupler Solvent on Fixed Upper Scale Contrast, Cyan Dye Hue, and Cyan Dye Dark Stability

| Element | Dispersion | Solvent | FUSC | λmax (nm) | Δ Red Density (85° C./40% RH) |
|---|---|---|---|---|---|
| 6 (Comparison) | F | CS-5 | 4.23 | 660.0 | −0.41 |
| 7 (Comparison) | G | CS-6 | 5.30 | 668.4 | −0.73 |
| 8 (Comparison) | H | CS-7 | 4.76 | 662.3 | −0.56 |
| 9 (Comparison) | I | CS-8 | 4.73 | 667.7 | −0.56 |
| 10 (Comparison) | J | CS-2/CS-3 | 4.34 | 664.0 | −0.46 |
| 11 (Invention) | K | CS-3/S-1 | 4.65 | 664.3 | −0.54 |
| 12 (Invention) | L | CS-4/S-1 | 4.91 | 664.7 | −0.52 |

The fixed upper scale contrast (FUSC) values are determined by calculating the slope of a line drawn between a point at a density of 1.0 and a point at 0.5 logE higher exposure. These values are related to coupler reactivity. Higher FUSC is desired for good shadow detail in the photographic image and it is higher as coupler reactivity is increased. In order to obtain good color reproduction, a deep cyan dye hue with a λmax value shifted to higher wavelengths is required (λmax≧664 nm). It is also desirable to minimize the red density loss due to cyan dye fade upon high temperature treatment.

The data in Table I illustrate that low FUSC values were obtained with CS-2, CS-3, and CS-5. Solvents CS-3, CS-4, CS-5, and CS-7 produced cyan dye hues which were shifted to lower wavelengths as indicated by their low λmax values. CS-6, which contains a hydroxyl group, significantly degraded cyan dye dark stability. S-1 was the only single component alternative to the phthalate esters in this experiment that provided high coupler reactivity and a deep cyan dye hue without degrading cyan dye dark stability. Solvent blends with S-1 (Dispersions K and L) also enabled these criteria to be met.

It is well known to those skilled in processing chemistry that the color developer step can be shortened by increasing the pH, temperature, color developer concentration, etc. (see, e.g., T. H. James, Ed., The Theory of the Photographic Process, $4^{th}$ ed. Macmillan, New York, 1977, Chapter 14). Elements 1–12 were exposed as described above and similarly processed except a slightly modified color developer was used in which the pH was adjusted to 10.8, the temperature was increased by 3° C., and the color development time was shortened to 2'20". The optical density due to dye formation was then measured as described above. The difference in red Dmax between the elements processed through the shortened modified process and the elements processed through Process ECP-2B are shown in Table IA.

TABLE IA

Effect of Coupler Solvent on Red Dmax Difference Observed Between Shortened Modified Process and Process ECP-2B

| Element | Dispersion | Solvent | Δ Red Dmax (Shortened Modified - ECP-2B) |
|---|---|---|---|
| 1 (Comparison) | A | CS-1 | 0.03 |
| 2 (Comparison) | B | CS-2 | 0.07 |
| 3 (Comparison) | C | CS-3 | 0.15 |
| 4 (Comparison) | D | CS-4 | 0.03 |
| 5 (Invention) | E | S-1 | 0.02 |
| 6 (Comparison) | F | CS-5 | 0.10 |
| 7 (Comparison) | G | CS-6 | 0.06 |

TABLE IA-continued

Effect of Coupler Solvent on Red Dmax Difference Observed Between Shortened Modified Process and Process ECP-2B

| Element | Dispersion | Solvent | Δ Red Dmax (Shortened Modified - ECP-2B) |
|---|---|---|---|
| 8 (Comparison) | H | CS-7 | 0.05 |
| 9 (Comparison) | I | CS-8 | 0.05 |
| 10 (Comparison) | J | CS-2/CS-3 | 0.10 |
| 11 (Invention) | K | CS-3/S-1 | 0.04 |
| 12 (Invention) | L | CS-4/S-1 | 0.00 |

It is important for motion picture color print film to give very similar sensitometric performance regardless of whether the standard Process ECP-2B or a shortened modified process is used. The data is Table IA clearly shows that a large and significant difference in red Dmax was attained with single component solvents CS-2, CS-3, CS-5, CS-6, CS-7, and CS-8. Only a small and insignificant difference in red Dmax was obtained with the single component solvents CS-2, CS-4, and S-1. However, solvent S-1 was the only solvent that meets the criteria of high coupler reactivity, deep cyan dye hue, and acceptable cyan dye dark stability as shown above. A small red Dmax difference was also evident with solvent blends CS-3/S-1 and CS-4/S-1. Only these two solvent blends meet the reactivity, hue, and dark stability criteria described above.

EXAMPLE 2

Dispersions M and N were prepared identical to Dispersions J and E, respectively, in Example 1. Dispersions O through S were similarly prepared using the coupler solvents outlined in Table II.

These dispersions were incorporated into multilayer photographic elements 13 through 19 by coating the following layers on a gelatin subbed polyethylene terephthalate support with a rem-jet carbon black containing backing layer.

Layer 1: Blue Light Sensitive Layer

AgClBr cubic grain emulsion, 0.28% Br, 0.72 micron, spectrally sensitized with SD-2, 0.1220 mmole/Ag mole and with SD-3, 0.1237 mmole/Ag mole, 278.8 mg/sq. m.

AgClBr cubic grain emulsion, 0.44% Br, 0.40 micron, spectrally sensitized with SD-2, 0.2277 mmole/Ag mole and with SD-3, 0.2310 mmole/Ag mole, 382.1 mg/sq. m.

AgClBr cubic grain emulsion, 0.45% Br, 0.32 micron, spectrally sensitized with SD-2, 0.1491 mmole/Ag mole and with SD-3, 0.1512 mmole/Ag mole, 135.6 mg/sq. m.

Yellow dye forming coupler (Y-1), 1334.7 mg/sq. m.

Ultraviolet absorber compound (UV-1), 107.6 mg/sq. m.

Sequestrant compound (SQ-1), 305.9 mg/sq. m.

Sequestrant compound (SQ-2), 100.0 mg/sq. m.

Gelatin, 2583.4 mg/sq. m.

Spreading aids.

Layer 2: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 3: Red Light Sensitive Layer

AgClBr cubic grain emulsion, 0.60% Br, 0.21 micron, spectrally sensitized with SD-1, 0.043 mmole/Ag mole, supersensitizer compound (SS-1), 0.263 mmole/Ag mole, 68.9 mg/sq. m.

AgClBr cubic grain emulsion, 0.87% Br, 0.15 micron, spectrally sensitized with SD-1, 0.051 mmole/Ag mole, supersensitizer compound (SS-1), 0.344 mmole/Ag mole, 346.6 mg/sq. m.

AgClBr cubic grain emulsion, 1.12% Br, 0.11 micron, spectrally sensitized with SD-1, 0.045 mmole/Ag mole, supersensitizer compound (SS-1), 0.336 mmole/Ag mole, 79.7 mg/sq. m.

Cyan dye forming coupler (C-1), 1022.6 mg/sq. m.

Coupler Solvent (CS-2), 511.3 mg/sq. m.

Coupler Solvent (CS-3), 511.3 mg/sq. m.

Gelatin, 3229.2 mg/sq. m.

Palladium compound (P-1), 8.1 mg/sq. m.

Spreading aids.

Layer 4: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 5: Green Light Sensitive Layer

AgClBr cubic grain emulsion, 1.35% Br, 0.21 micron, spectrally sensitized with SD-4, 0.228 mmole/Ag mole and with SD-5, 0.005 mmole/Ag mole, 61.4 mg/sq. m.

AgClBr cubic grain emulsion, 2.10% Br, 0.15 micron, spectrally sensitized with SD-4, 0.323 mmole/Ag mole and with SD-5, 0.007 mmole/Ag mole, 355.2 mg/sq. m.

AgClBr cubic grain emulsion, 1.75% Br, 0.11 micron, spectrally sensitized with SD-4, 0.363 mmole/Ag mole and with SD-5, 0.008 mmole/Ag mole, 57.0 mg/sq. m.

Magenta dye forming coupler (M-1), 721.2 mg/sq. m.

Coupler Solvent (CS-1), 215.3 mg/sq. m.

Gelatin, 1872.9 mg/sq. m.

Spreading aids.

Layer 6: Protective Overcoat Layer

Poly (dimethyl siloxane) 200-CS, 16.5 mg/sq. m.

Poly (methyl methacrylate) beads, 16.1 mg/sq. m.

Gelatin, 977.4 mg/sq. m.

Soluble green absorber dye (AD-1), 32.3 mg/sq. m.

Soluble green absorber dye (AD-2), 48.4 mg/sq. m.

Soluble blue absorber dye (AD-3), 48.4 mg/sq. m.

Soluble red absorber dye (AD-4), 96.9 mg/sq. m.

Gelatin hardener.

Spreading aids.

The elements were exposed and processed as previously described. Densitometry, spectrophotometric measurements, and high temperature dye fading tests were also carried out as described in Examplel. Photographic results are summarized below in Table II. Certain coupler solvent characteristics are included for reference.

TABLE II

Effect of Coupler Solvent on Fixed Upper Scale Contrast, Cyan Dye Hue, and Cyan Dye Dark Stability

| Element | Disp. | Solvent | Viscosity (cp) | Log P | FUSC | γmax (nm) | Δ Red Density (85° C./ 40% RH) |
|---|---|---|---|---|---|---|---|
| 13 (Comp) | M | CS-2/ CS-3 | 63.5/ 11.8 | 6.58/ 9.49 | 4.06 | 664 | −0.81 |
| 14 (Inv) | N | S-1 | 14.0 | 4.06 | 4.64 | 671 | −0.96 |

TABLE II-continued

Effect of Coupler Solvent on Fixed Upper Scale Contrast, Cyan Dye Hue, and Cyan Dye Dark Stability

| Element | Disp. | Solvent | Viscosity (cp) | Log P | FUSC | γmax (nm) | Δ Red Density (85° C./ 40% RH) |
|---|---|---|---|---|---|---|---|
| 15 (Comp) | O | CS-9 | 6.0 | 5.68 | 4.81 | 663 | −0.78 |
| 16 (Inv) | P | S-2 | 15.0 | 4.59 | 4.67 | 666 | −0.89 |
| 17 (Comp) | Q | S-3 | 1000 | 6.09 | 3.89 | 667 | −0.84 |
| 18 (Inv) | R | S-4 | 265 | 5.36 | 4.16 | 664 | −0.77 |
| 19 (Inv) | S | S-5 | 122 | 4.50 | 4.26 | 671 | −0.99 |

These results indicate that all of the solvents examined provide the desired deep cyan dye hue (λmax≧664 nm) except CS-9. A very bluish dye hue was obtained with S-10, which is not clearly evident from the λmax value. The bluish hue is attributed to the low polarity of this solvent since it is an alkyl ester of benzoic acid. High FUSC values were obtained with S-1, CS-9, and S-2 which have low viscosities, while more viscous solvents such as S-3, S-4, and S-5 yielded low FUSC. However, these solvents may still be useful when combined with another low viscosity solvent. All of these solvents provided acceptable cyan dye dark stability, but it is evident from the data that those solvents with relatively low log P values were poorer. Hence, solvents with even lower log P values than 4.0, such as phenyl methyl benzoate, would not be desirable for cyan dye dark stability.

Elements 13–19 were exposed as described above and similarly processed except that a slightly modified color developer was used in which the pH was adjusted to 10.8, the temperature was increased by 3° C., and the color development time was shortened to 2'20". The optical density due to dye formation was then measured. The difference in red Dmax between the elements processed through the shortened modified process and the elements processed through Process ECP-2B are shown in Table IIA.

TABLE IIA

Effect of Coupler Solvent on Red Dmax Difference Observed Between Shortened Modified Process and Process ECP-2B

| Element | Dispersion | Solvent | Δ Red Dmax (Shortened Modified - ECP-2B) |
|---|---|---|---|
| 13 (Comparison) | M | CS-2/CS-3 | 0.21 |
| 14 (Invention) | N | S-1 | 0.08 |
| 15 (Comparison) | O | CS-9 | 0.09 |
| 16 (Invention) | P | S-2 | 0.08 |
| 17 (Comparison) | Q | S-3 | 0.21 |
| 18 (Invention) | R | S-4 | 0.16 |
| 19 (Invention) | S | S-5 | 0.15 |

The data in Table IIA clearly shows that there was a larger difference in red Dmax in the multilayer coatings that were made with the solvent blend CS-2/CS-3 and the single component solvent S-3 than in the coatings made with the single component solvents S-1, CS-9, S-2, S-4, and S-5. Although solvent CS-9 manifested a small difference in Dmax between these two processes like the other invention solvents, it did not provide the desirable deep cyan hue like the invention solvents in this example.

EXAMPLE 3

Dispersions T, U, and AA were prepared identical to Dispersions J, E, and D, respectively, in Example 1. Dispersions U through Z were similarly prepared using the coupler solvents outlined in Table III. Dispersion Y employed a 2:1 blend of S-6 and CS-4. Dispersion Z employed a 4:1 blend of S-8 and CS-4.

These dispersions were incorporated into multilayer photographic elements 20 through 27 by coating the following layers on a gelatin subbed polyethylene terephthalate support with a rem-jet carbon black containing backing layer.

Layer 1: Blue Light Sensitive Layer

AgClBr cubic grain emulsion, 0.28% Br, 0.72 micron, spectrally sensitized with SD-2, 0.1220 mmole/Ag mole and with SD-3, 0.1237 mmole/Ag mole, 278.8 mg/sq. m.

AgClBr cubic grain emulsion, 0.44% Br, 0.40 micron, spectrally sensitized with SD-2, 0.2277 mmole/Ag mole and with SD-3, 0.2310 mmole/Ag mole, 438.1 mg/sq. m.

AgClBr cubic grain emulsion, 0.45% Br, 0.32 micron, spectrally sensitized with SD-2, 0.1491 mmole/Ag mole and with SD-3, 0.1512 mmole/Ag mole, 79.7 mg/sq. m.

Yellow dye forming coupler (Y-1), 1334.7 mg/sq. m.

Ultraviolet absorber compound (UV-1), 107.6 mg/sq. m.

Sequestrant compound (SQ-1), 305.9 mg/sq. m.

Sequestrant compound (SQ-2), 100.0 mg/sq. m.

Gelatin, 2583.4 mg/sq. m.

Spreading aids.

Layer 2: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 3: Red Light Sensitive Layer

AgClBr cubic grain emulsion, 0.60% Br, 0.21 micron, spectrally sensitized with SD-1, 0.043 mmole/Ag mole, supersensitizer compound (SS-1), 0.263 mmole/Ag mole, 68.9 mg/sq. m.

AgClBr cubic grain emulsion, 0.87% Br, 0.15 micron, spectrally sensitized with SD-1, 0.051 mmole/Ag mole, supersensitizer compound (SS-1), 0.344 mmole/Ag mole, 346.6 mg/sq. m.

AgClBr cubic grain emulsion, 1.12% Br, 0.11 micron, spectrally sensitized with SD-1, 0.045 mmole/Ag mole, supersensitizer compound (SS-1), 0.336 mmole/Ag mole, 79.7 mg/sq. m.

Cyan dye forming coupler (C-1), 1022.6 mg/sq. m.

Coupler Solvent (CS-2), 511.3 mg/sq. m.

Coupler Solvent (CS-3), 511.3 mg/sq. m.

Gelatin, 3229.2 mg/sq. m.

Palladium compound (P-1), 8.1 mg/sq. m.

Spreading aids.

Layer 4: Interlayer

Oxidized developer scavenger (SC-1), 86.1 mg/sq. m.

Antifoggant compound (AF-1), 2.7 mg/sq. m.

Gelatin, 645.6 mg/sq. m.

Spreading aids.

Layer 5: Green Light Sensitive Layer

AgClBr cubic grain emulsion, 1.35% Br, 0.21 micron, spectrally sensitized with SD-4, 0.228 mmole/Ag mole and with SD-5, 0.005 mmole/Ag mole, 74.3 mg/sq. m.

AgClBr cubic grain emulsion, 1.89% Br, 0.15 micron, spectrally sensitized with SD-4, 0.323 mmole/Ag mole and with SD-5, 0.007 mmole/Ag mole, 336.9 mg/sq. m.

AgClBr cubic grain emulsion, 1.75% Br, 0.11 micron, spectrally sensitized with SD-4, 0.363 mmole/Ag mole and with SD-5, 0.008 mmole/Ag mole, 84.0 mg/sq. m.

Magenta dye forming coupler (M-1), 721.2 mg/sq. m.

Coupler Solvent (CS-2), 215.3 mg/sq. m.

Gelatin, 1872.9 mg/sq. m.

Spreading aids.

Layer 6: Protective Overcoat Layer

Poly (dimethyl siloxane) 200-CS, 16.5 mg/sq. m.

Poly (methyl methacrylate) beads, 16.1 mg/sq. m.

Gelatin, 977.4 mg/sq. m.

Soluble green absorber dye (AD-1), 32.3 mg/sq. m.

Soluble green absorber dye (AD-2), 48.4 mg/sq. m.

Soluble blue absorber dye (AD-3), 48.4 mg/sq. m.

Soluble red absorber dye (AD-4), 96.9 mg/sq. m.

Gelatin hardener.

Spreading aids.

The elements were exposed and processed as previously described. Densitometry, spectrophotometric measurements, and high temperature dye fading tests were also carried out as described in Example 1. Photographic results are summarized below in Table III. Certain coupler solvent characteristics are included for reference.

TABLE III

Effect of Coupler Solvent on Fixed Upper Scale Contrast, Cyan Dye Hue, and Cyan Dye Dark Stability

| Element | Disp. | Solvent | Viscosity (cp) | Log P | FUSC | γmax (nm) | Δ Red Density (85° C./ 40% RH) |
|---|---|---|---|---|---|---|---|
| 20 (Comp) | T | CS-2/ CS-3 | 63.5/ 11.8 | 6.58/ 9.49 | 4.23 | 663 | −0.50 |
| 21 (Inv) | U | S-1 | 14.0 | 4.06 | 4.73 | 674 | −0.65 |
| 22 (Inv) | V | S-6 | 157 | 5.72 | 4.43 | 670 | −0.53 |
| 23 (Inv) | W | S-7 | 22.0 | 5.09 | 4.70 | 669 | −0.50 |
| 24 (Inv) | X | S-8 | 70.0 | 5.12 | 4.59 | 669 | −0.56 |
| 25 (Inv) | Y | S-6/ CS-4 | 157/ 8.6 | 5.72/ 5.98 | 4.66 | 668 | −0.51 |
| 26 (Inv) | Z | S-8/ CS-4 | 70/ 8.6 | 5.12/ 5.98 | 4.74 | 666 | −0.54 |
| 27 (Comp) | AA | CS-4 | 8.6 | 5.98 | 4.86 | 660 | −0.48 |

All of these solvents and solvent blends provided higher FUSC values than the control. Slightly lower FUSC increases were evident with the more viscous solvents S-6 and S-8. Results with Dispersions Y and Z show that FUSC can be boosted by blending these solvents with a low viscosity solvent (CS-4). All of the solvents of the present invention exhibited a deep cyan dye hue (λmax≧664 nm), including the mixtures with CS-4. The use of CS-4 alone shifted λmax to lower wavelengths as observed in Example 1. All of the solvents and solvent blends provided acceptable cyan dye dark stability. However, dark fade was increased slightly with S-1, which has a moderately low log P value.

Elements 20–27 were exposed as described above and similarly processed except that a slightly modified color developer was used in which the pH was adjusted to 10.8, the temperature was increased by 3° C., and the color development time was shortened to 2'20". The optical density due to dye formation was then measured. The difference in red Dmax between the elements processed through the shortened modified process and the elements processed through Process ECP-2B are shown in Table IIIA.

TABLE IIIA

Effect of Coupler Solvent on Red Dmax Difference Observed Between Shortened Modified Process and Process ECP-2B

| Element | Dispersion | Solvent | Δ Red Dmax (Shortened Modified - ECP-2B) |
|---|---|---|---|
| 20 (Comparison) | T | CS-2/CS-3 | 0.22 |
| 21 (Invention) | U | S-1 | 0.15 |
| 22 (Invention) | V | S-6 | 0.15 |
| 23 (Invention) | W | S-7 | 0.13 |
| 24 (Invention) | X | S-8 | 0.16 |
| 25 (Invention) | Y | S-6/CS-4 | 0.15 |
| 26 (Invention) | Z | S-8/CS-4 | 0.15 |
| 27 (Comparison) | AA | CS-4 | 0.10 |

It is evident from the data in Table IIIA that there was a larger difference in red Dmax in the multilayer coatings that were made with the solvent blend CS-2/CS-3 than in the coatings made with the single component solvents S-1, S-6, S-7, S-8, CS-4, and the solvent blends S-6/CS-4 and S-8/CS-4. Although solvent CS-4 manifested a small difference in Dmax between these two processes like the other invention solvents in this example, it did not provide a deep cyan hue for desirable color reproduction like the other invention solvents.

CS-1=Dibutyl phthalate

CS-2=Tricresyl phosphate

CS-3=Tris-(2-ethylhexyl) phosphate

CS-4=Dibutyl sebacate

CS-5=Dibutyl dodecanamide

CS-6=Oleyl alcohol

CS-7=1,4 Cyclohexylene dimethylene bis(2-ethylhexanoate)

CS-8=Diundecyl phthalate

CS-9=2-Ethylhexyl benzoate

S-1=Phenyl ethyl benzoate

S-2=Phenyl propyl benzoate

S-3=2, 2, 4-Trimethyl-1,3-pentanediol dibenzoate

S-4=1,3-Butanediol di-p-toluate

S-5=Di(propylene glycol) dibenzoate

S-6=1,2-Hexanediol dibenzoate

S-7=3-Phenylpropyl p-toluate

S-8=1,5-Pentanediol dibenzoate solvent CS-1

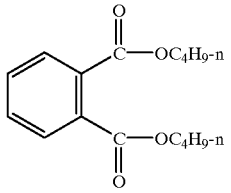

-continued
solvent CS-2
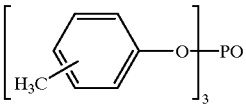
solvent CS-3
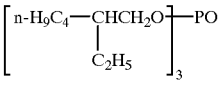
solvent CS-4
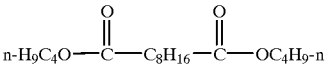
solvent CS-5
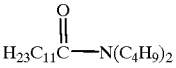
solvent CS-6
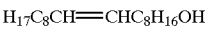
solvent CS-7
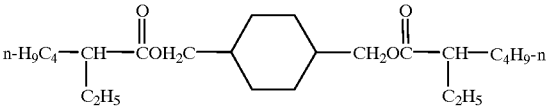
solvent CS-8
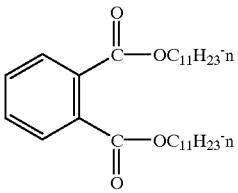
solvent CS-9
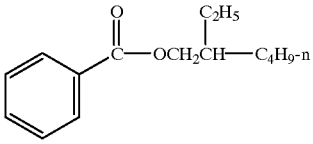
red sensitizing dye SD-1
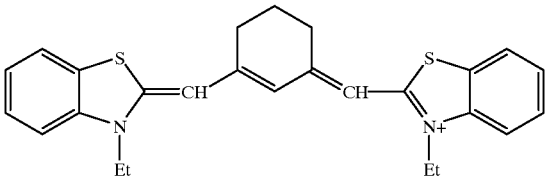
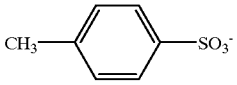
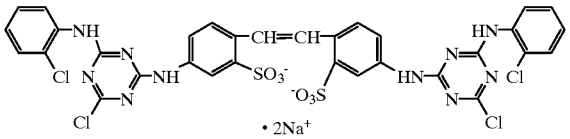
supersensitizer SS-1
-continued
blue sensitizing dye SD-2 and SD-3
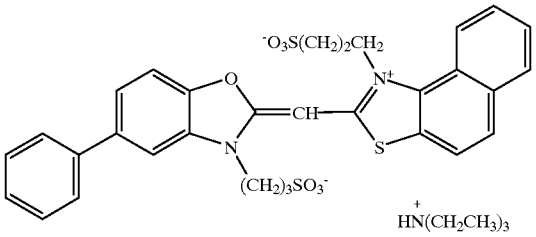
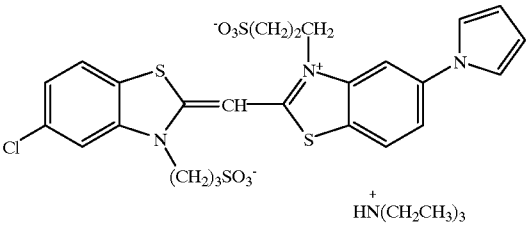
yellow coupler Y-1
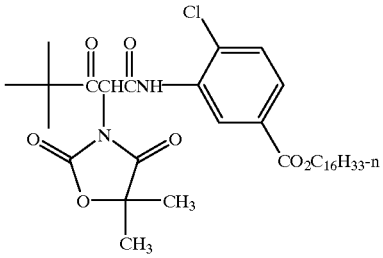
Ultraviolet absorber compound UV-1
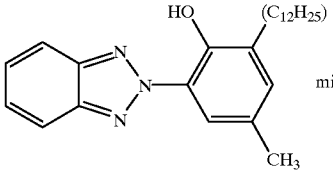
mixed branch and linear $C_{12}H_{25}$
sequestrant SQ-1
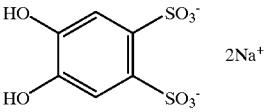
sequestrant SQ-2
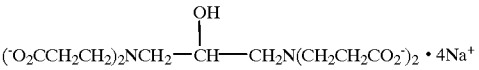
scavenger SC-1
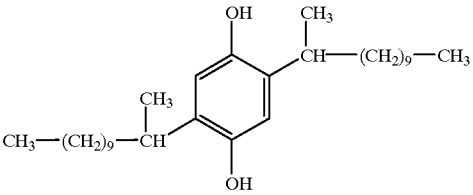

-continued

Antifoggant compound AF-1

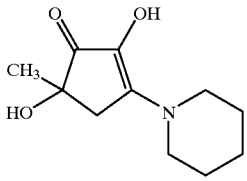

Palladium compound P-1

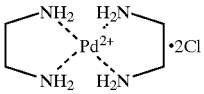

green sensitizing dye SD-4 and SD-5

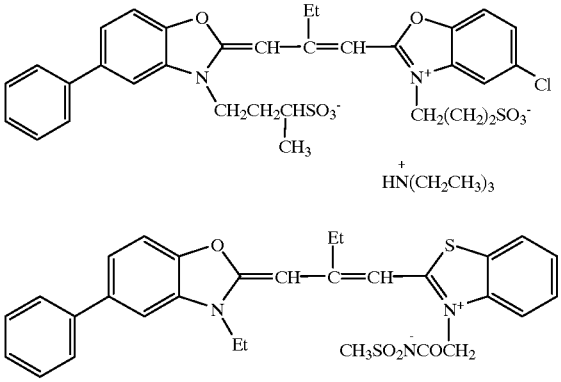

magenta coupler M-1

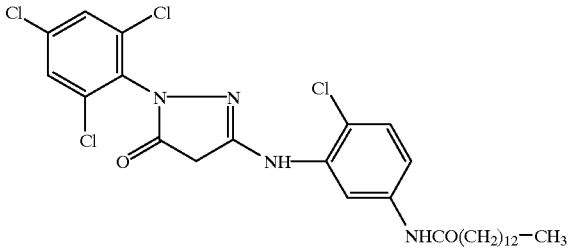

soluble green filter dye AD-1

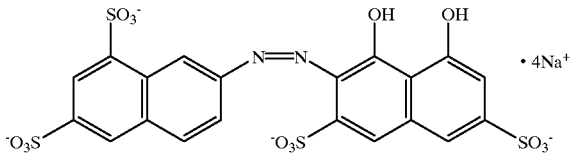

soluble green filter dye AD-2

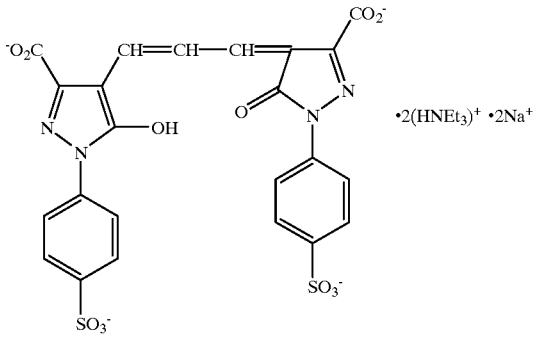

-continued soluble blue filter dye AD-3

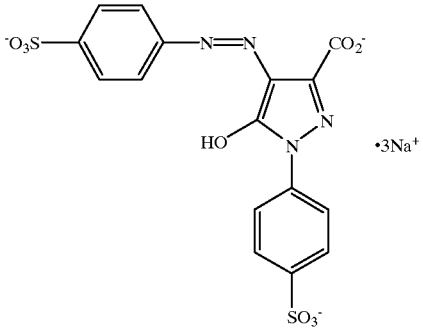

soluble red filter dye AD-4

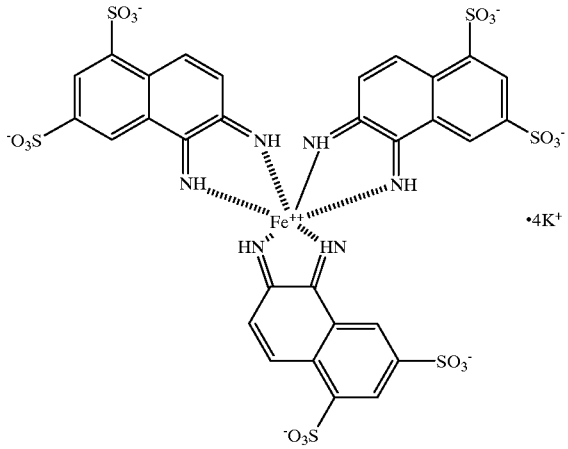

PINA Filter Dye Bluegreen
from Riedel deHaen

This invention has been described in detail with particular reference to preferred embodiments thereof. It will be understood that variations and modifications can be made within the spirit and scope of the invention.

We claim:

1. A silver halide light sensitive photographic element comprising a support bearing at least one cyan image forming hydrophilic colloid layer comprising cyan image dye forming coupler of Formula I and benzoic acid ester or diester high boiling solvent of Formula II:

Formula I

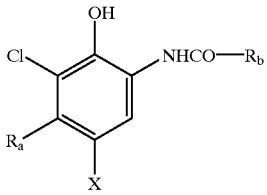

wherein:

$R_a$ represents an alkyl group, $R_b$ represents a ballast group, and

X represents hydrogen or a coupling-off group;

Formula II

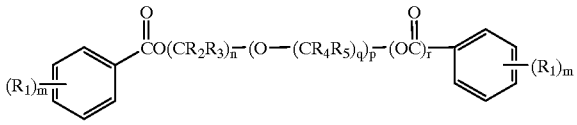

wherein:

each m is independently 0, 1, 2 or 3;

each $R_1$ is an individually selected alkyl group with up to four carbon atoms;

n is 1 to 7;

each $R_2$, $R_3$, $R_4$ and $R_5$ may be the same or different and is individually selected from hydrogen or an alkyl group with up to four carbon atoms;

p is 0 to 3;

q is 1 to 7;

r is 0 or 1; and the log P of said high-boiling solvent is at least 4.5.

2. A silver halide light sensitive photographic element comprising a support bearing in sequential order on one side thereof at least one yellow image forming hydrophilic colloid layer comprising a blue-sensitive silver halide emulsion and yellow image dye forming coupler, at least one cyan image forming hydrophilic colloid layer comprising red-sensitive silver halide emulsion and cyan image dye forming coupler, and at least one magenta image forming hydrophilic colloid layer comprising green-sensitive silver halide emulsion and magenta image dye forming coupler; wherein the cyan image forming hydrophilic colloid layer comprises cyan image dye forming coupler of Formula I and benzoic acid ester high boiling solvent of Formula II:

Formula I

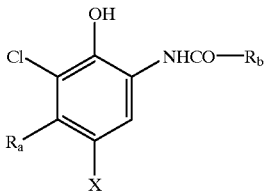

wherein:

$R_a$ represents an alkyl group, $R_b$ represents a ballast group, and

X represents hydrogen or a coupling-off group;

Formula II

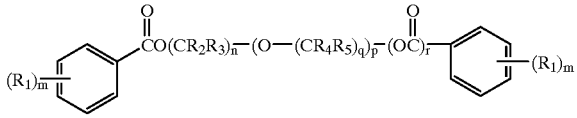

wherein:

each m is independently 0, 1, 2 or 3;

each $R_1$ is an individually selected alkyl group with up to four carbon atoms;

n is 1 to 7;

each $R_2$, $R_3$, $R_4$ and $R_5$ may be the same or different and is individually selected from hydrogen or an alkyl group with up to four carbon atoms;

p is 0 to 3;

q is 1 to 7;

r is 0 or 1;

and the log P of the solvent is at least 4.0.

3. A photographic element according to claim 2, wherein p and r are 0 and the sum of the number of carbon atoms in each $R_1$ plus each $R_2$ plus each $R_3$ taken together is 2 to 7.

4. A photographic element according to claim 3, wherein the number of carbon atoms in each $R_1$ plus each $R_2$ plus each $R_3$ plus $R_4$ taken together is three to five.

5. A photographic element according to claim 2, wherein the viscosity of said high-boiling solvent at 25° C. is less than 50 centipoise.

6. A photographic element according to claim 2, wherein each m is 0.

7. A photographic element according to claim 2, wherein each m is 1 and each $R_1$ is a methyl group.

8. A photographic element according to claim 2, wherein p is 0, r is 1 and the sum of the number of carbon atoms in each $R_1$ plus each $R_2$ plus each $R_3$ taken together is 4 to 8.

9. A photographic element according to claim 2, wherein p is 1, r is 1 and the sum of the number of carbon atoms in each $R_1$ plus each $R_2$ plus each $R_3$ plus each $R_4$ plus each $R_5$ taken together is 6 to 10.

10. A silver halide light sensitive photographic element according to claim 2, wherein the high-boiling solvent is selected from the group consisting of:

S-1

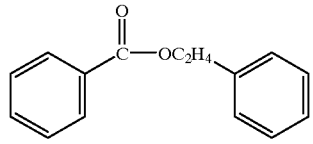

S-2

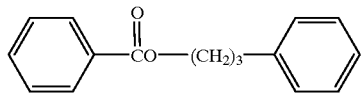

S-3

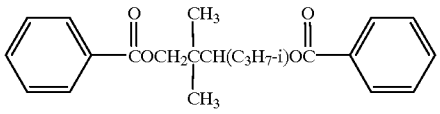

S-4

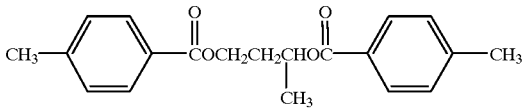

S-5

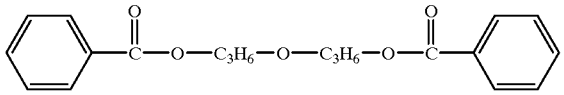

S-6

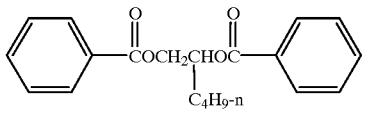

-continued

S-7

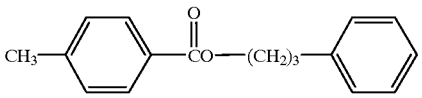

and

S-8

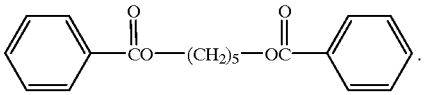

11. The element of claim 2, having an effective ISO speed rating of less than about 10.

12. The element of claim 2, wherein the yellow image forming layer and adjacent image forming layer each comprises silver chloride or bromochloride emulsion grains comprising greater than 50 mole % chloride.

13. The element of claim 12, wherein the emulsion grains have an average equivalent circular diameter of less than 1 micron and an aspect ratio of less than 1.3.

14. The element of claim 2, wherein $R_a$ represents an ethyl substituent.

15. The element of claim 14, wherein X represents a chloro substituent.

16. The element of claim 15, wherein $R_b$ represents —CHR'—O—Aryl, where R' represents an alkyl group of from 1 to 12 carbon atoms and Aryl represents an aryl substituent.

17. The element of claim 2, wherein each of the blue-sensitive, red-sensitive, and green-sensitive silver emulsions comprise silver chloride or silver bromochloride emulsion grains comprising greater than 50 mole % chloride.

18. The element of claim 17, wherein each of the red-sensitive and green-sensitive silver halide emulsions comprise emulsion grains having an average equivalent circular diameter of less than 0.60 micron, and the blue-sensitive silver halide emulsion comprises emulsion grains having an average equivalent circular diameter of less than 0.90 micron.

19. A motion picture color print film element comprising a transparent polymeric film support bearing in sequential order on one side thereof at least one yellow image forming hydrophilic colloid layer, at least one cyan image forming hydrophilic colloid layer, and at least one magenta image forming hydrophilic colloid layer according to claim 2.

* * * * *